US005395057A

United States Patent [19]

Williams, Jr. et al.

[11] Patent Number: 5,395,057

[45] Date of Patent: Mar. 7, 1995

[54] INTERCHANGEABLE AND REVERSIBLE MATERIAL REDUCING APPARATUS

[75] Inventors: Robert M. Williams, Jr.; Robert M. Williams, Sr., both of St. Louis, Mo.

[73] Assignee: Williams Patent Crusher & Pulverizer Company, St. Louis, Mo.

[21] Appl. No.: 176,240

[22] Filed: Jan. 3, 1994

[51] Int. Cl.[6] ..... B02C 18/18; B02C 25/00

[52] U.S. Cl. ..... 241/36; 241/236; 241/285.2

[58] Field of Search ..... 241/236, 285.1, 285.2, 241/36

[56] References Cited

U.S. PATENT DOCUMENTS

| | | | |
|---|---|---|---|
| 544,294 | 8/1895 | Evans | 241/236 |
| 1,637,965 | 8/1927 | Schmidt et al. | 241/236 |
| 1,679,593 | 8/1928 | Williamson et al. | 205/140 |
| 3,306,441 | 2/1967 | Sanders et al. | 209/106 |
| 3,578,252 | 5/1971 | Brewer | 241/141 |
| 3,868,062 | 2/1975 | Cunningham et al. | 241/36 |
| 4,034,918 | 7/1977 | Culbertson et al. | 241/36 |
| 4,082,232 | 4/1978 | Brewer | 241/236 |
| 4,301,930 | 11/1981 | Smith | 209/671 |
| 4,385,732 | 5/1985 | Williams | 241/167 |
| 4,452,694 | 6/1984 | Christensen et al. | 209/672 |
| 4,658,964 | 4/1987 | Williams | 209/552 |
| 4,795,036 | 1/1989 | Williams | 209/667 |
| 5,285,973 | 2/1994 | Goforth et al. | 241/36 |

FOREIGN PATENT DOCUMENTS

| | | | |
|---|---|---|---|
| 1607936 | 11/1990 | U.S.S.R. | 241/236 |

*Primary Examiner*—John Husar

*Attorney, Agent, or Firm*—Polster, Lieder, Woodruff & Lucchesi

[57] ABSTRACT

Material reducing apparatus having a drive arrangement for a pair of shafts carrying double edge cutter discs, motor driven transmissions for each shaft having different speed characteristics for reducing motor speeds to double digit speeds, bearings mounted in pillow blocks so that the pillow blocks can be opened to allow removal of the bearings so the shafts carrying the double edge cutters can be repositioned to present the cutters selectively to reduce material with either edge of the double edge cutters. The drive arrangement is also duplicated at the opposite ends of the pair of shafts for selective connection to drive the shafts either by one of the drive arrangements or by the duplicate drive arrangement.

15 Claims, 6 Drawing Sheets

INTERCHANGEABLE AND REVERSIBLE MATERIAL REDUCING APPARATUS

BACKGROUND OF THE INVENTION

1. Field Of the Invention

This invention is directed to material reducing apparatus having dual rotor drives to permit reversibility of the rotors to correct for wear in the rotors and to provide a unique split bearing arrangement to allow rapid servicing of the apparatus.

DESCRIPTION OF THE PRIOR ART

The art is struggling with apparatus having cooperating rotors with material processing discs mounted on drive shafts which hold a large number of discs usually slidable on the shafts so that if a disc needs to be replaced a complement of discs on a given shaft must be removed to make the desired repair. An example is found in Williamson et al U.S. Pat. No. 1,679,593 of Aug. 7, 1928 where it is admitted that repairs require a considerable expenditure of time and labor to remove and replace discs. Additionally it is frequently necessary to remove a shaft from its bearings in the apparatus to permit repair.

In apparatus of the character shown in Sanders et al U.S. Pat. No. 3,306,441 of Feb. 28, 1967 when a repair is required on a roll, it is necessary to pull out a dowl shaft in an axial direction without disturbing the end bearings so that the entire shaft can be vertically lifted from its position between the end bearings. This arrangement involves labor and time to remove and replace the same shaft.

It is known in Brewer U.S. Pat. No. 3,578,252 of May 11, 1971 to provide an industrial shredder with oppositely rotating shafts carrying sets of knives or cutting blades which have bearings to support the shafts. These shafts carry members which rotate and carry interchangeable cutter blades that are removable from the shafts while the shafts are not intended to be removable because the cooperating fixed cutter bars and cutters are sufficiently exposed to allow ready access to the attachment bolts without requiring shaft removal.

It is also known that Culbertson et al U.S. Pat. No. 4,034,918 of Jul. 12, 1977 has counter rotating shafts supporting material reducing cutter disc elements, but there is no provision for shaft removal without dismantling the entire frame.

The disclosure in Smith U.S. Pat. No. 4,301,930 of Nov. 24, 1981 presents a disc screen apparatus in which the respective shafts are supported in solid bearings of ring disc form.

Applicants are also aware of other prior art examples such as Cunningham et al U.S. Pat. No. 3,868,062 of Feb. 25, 1975; Christensen et al U.S. Pat. No. 4,452,694 of Jun. 5, 1984; Williams U.S. Pat. No. 4,658,964 of Apr. 21, 1987; and Williams U.S. Pat. No. 4,795,036 of Jan. 3, 1989. The specific configuration of the shredding discs is shown in Williams U.S. Pat. No. 4,385,732 of May 31, 1983.

The foregoing prior art display common problems with material reducing apparatus, such as not being constructed to make repairs at minimum expense due to heavy duty service use. Such apparatus does not provide easy removability of the cutter discs or access to the shafts which carry the discs so shaft removal and replacement is facilitated. Further problems are noted in which a common drive for counter rotating shafts makes it difficult to easily interchange shafts, or even shift rotor shafts end-for-end.

None of the foregoing prior art examples have recognized the problem with material reducing apparatus when repair or replacement of cutter discs is required. The character of construction prevailing requires hours and expense of repair and down time while the apparatus is out of service. There does not seem to appear that any thought was given to repair of this character of apparatus, even though this sort of apparatus is designed to receive hard service.

SUMMARY OF THE INVENTION

A primary object associated wtih the material reducing apparatus shown in the drawings is to mount dual counter rotating shafts in dual pillow type bearing blocks to accommodate a desirable range of initial assembly and alteration in that assembly to extend the useful life of the cutting and ripping teeth so that opposite cutting edges of the teeth can be placed in service before the useful life of such teeth is reached.

An important object is to be able to reverse the position of the rotary shafts for overcoming wear without a great deal of expense or down time of the apparatus.

Another object is to provide separate motor drives for the dual shafts so that different drive speeds of the separate motors can be applied to either shaft as desired.

Another object in a dual shaft apparatus is directed to a construction of the feed hopper to incorporate the shaft bearings whereby on reversing the end-for-end of the shafts the labor and expense is greatly reduced.

A further object is to relocate the dual shafts in a material reducing apparatus so that less used ends of the shafts can be moved to occupy material feeding areas where uneven material feeding habits are compensated for.

A further object is to relocate not only the shaft teeth, but relocate the slow and fast shafts so they are subject to the different speeds whereby the teeth are driven according to the change in the shaft speeds.

Yet another object is to be able to remove a shaft having defective or worn teeth and replace it with a standby shaft that is either new or one that has been repaired.

An additional object is to provide a dual motor drive for the material reducing shafts so that if the drive assembly between the motor and a shaft slips the slippage will be detected to bring in the second motor to attempt to increase the power the shaft through a jam condition before a shaft reversal occurs to drive the shafts in the reverse direction for a sufficient degree that will clear any jam condition that will allow normal operation.

BRIEF DESCRIPTION OF THE DRAWINGS

The apparatus in its best mode is illustrated in the accompanying drawings, wherein.

DETAILED DESCRIPTION OF THE BEST MODE OF THE APPARATUS

Figure 1:
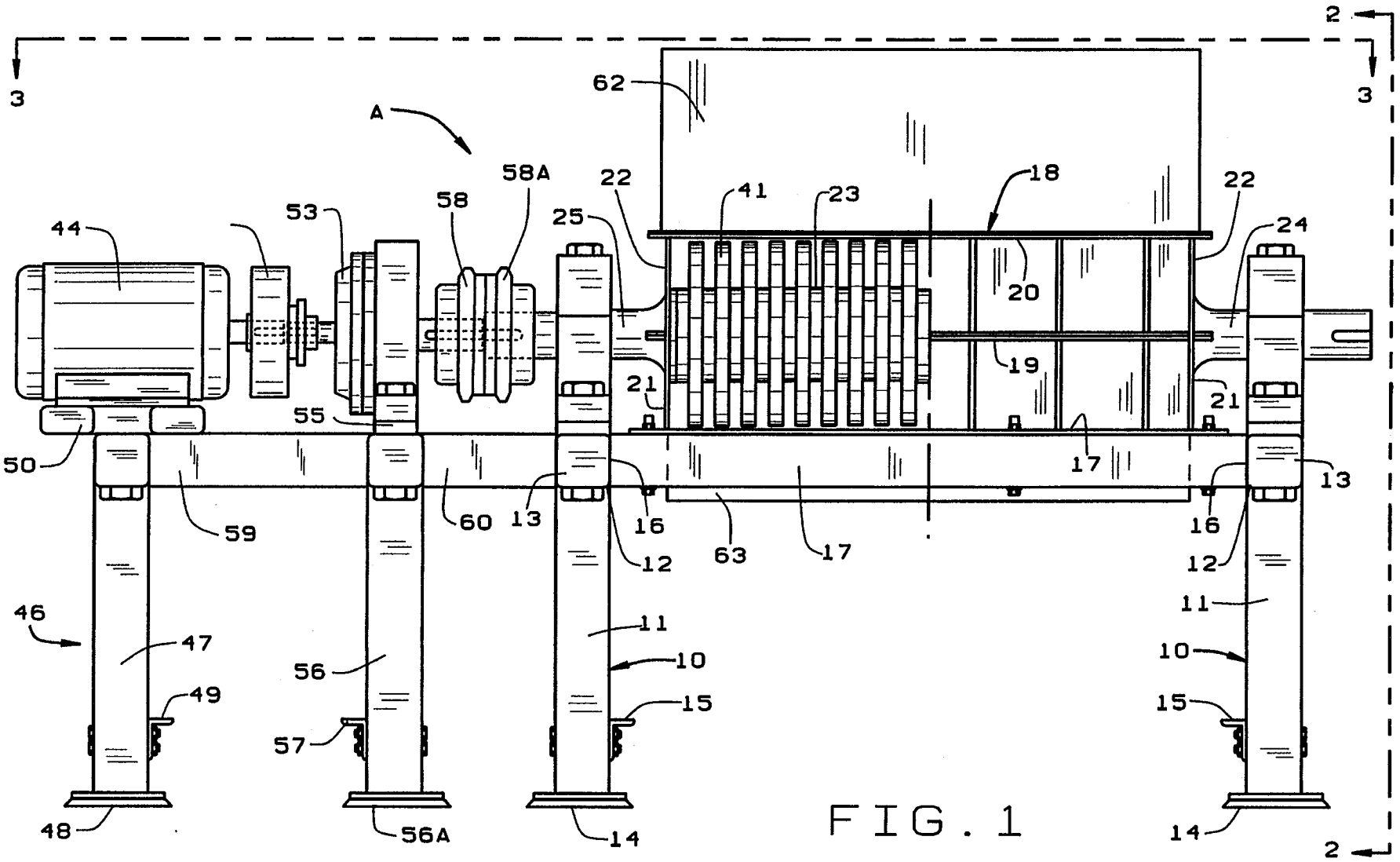
FIG. 1 is a longitudinal side elevation view with portions broken away to show internal details.
Figure 2:
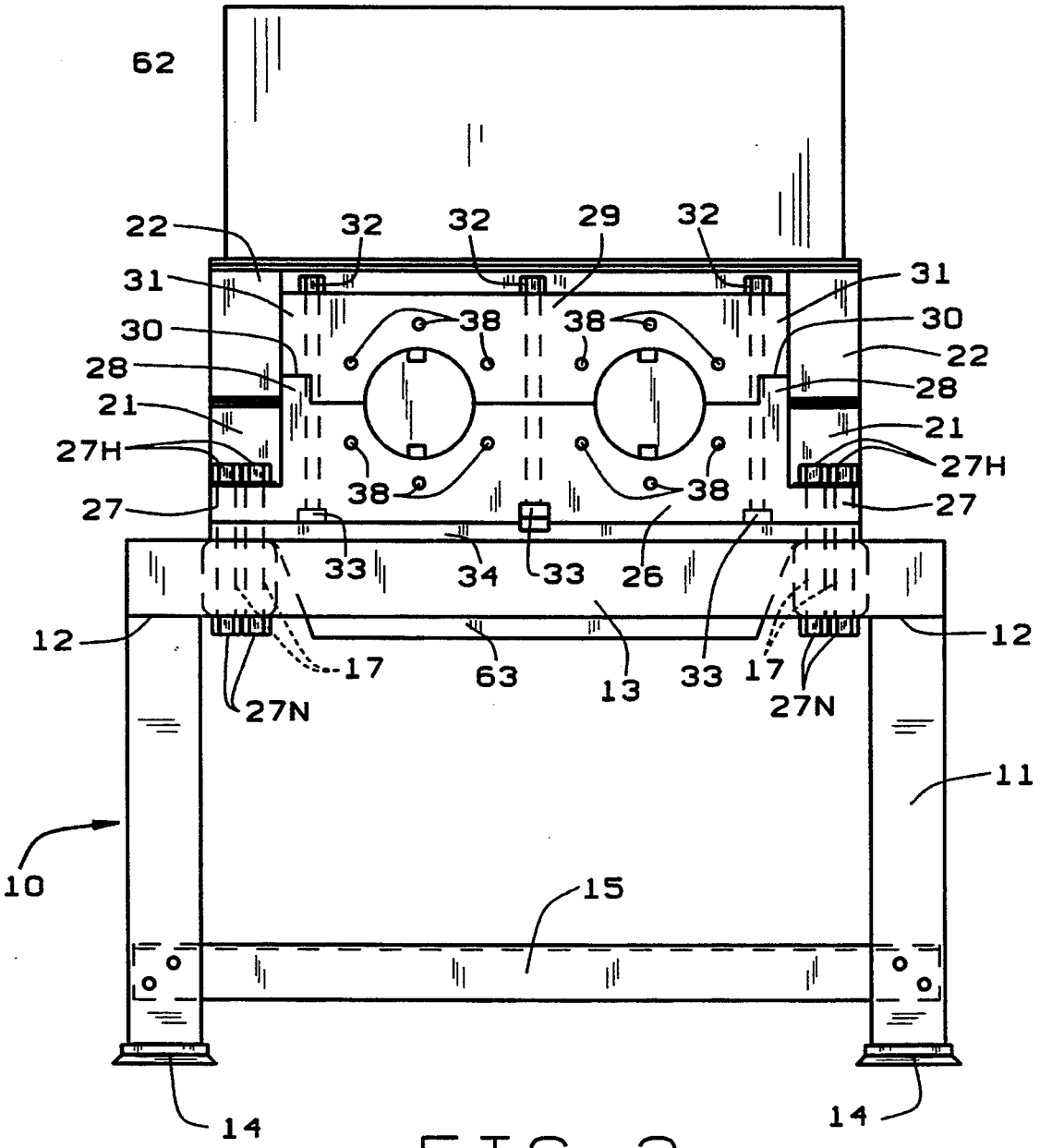
FIG. 2 is an end elevation view taken along line 2—2 in FIG. 1.

In FIGS. 1 and 2 embodiment A of the apparatus is assembled in a frame 10 of substantially square metal tubular stock having pairs of vertical legs 11 presenting upper ends 12 to support transverse beams 13. The legs 11 have footings 14, and there is a flanged member 15 attached to the pairs of legs 11 to hold the legs in position, as well as offer support for material conveyor means (not shown). The frame legs 11 are held in spaced positions between the abutted ends 16 of longitudinal beams 17. When the beams 13 and 17 are considered together there results a rectangular frame in a horizontal plane to receive the operating shafts of the apparatus in an enclosure consisting of side wall frame 18 made up of a bottom portion 19 and sitting on that is an upper portion 20. The side walls are connected to end walls and are made up of lower portions 21 and upper portions 22. See FIGS. 1 and 2. In FIG. 1, a part of side wall 18 has been broken away to show one rotary shaft assembly 23 having an idler shaft end 24 and a driver shaft end 25.

Figure 3:
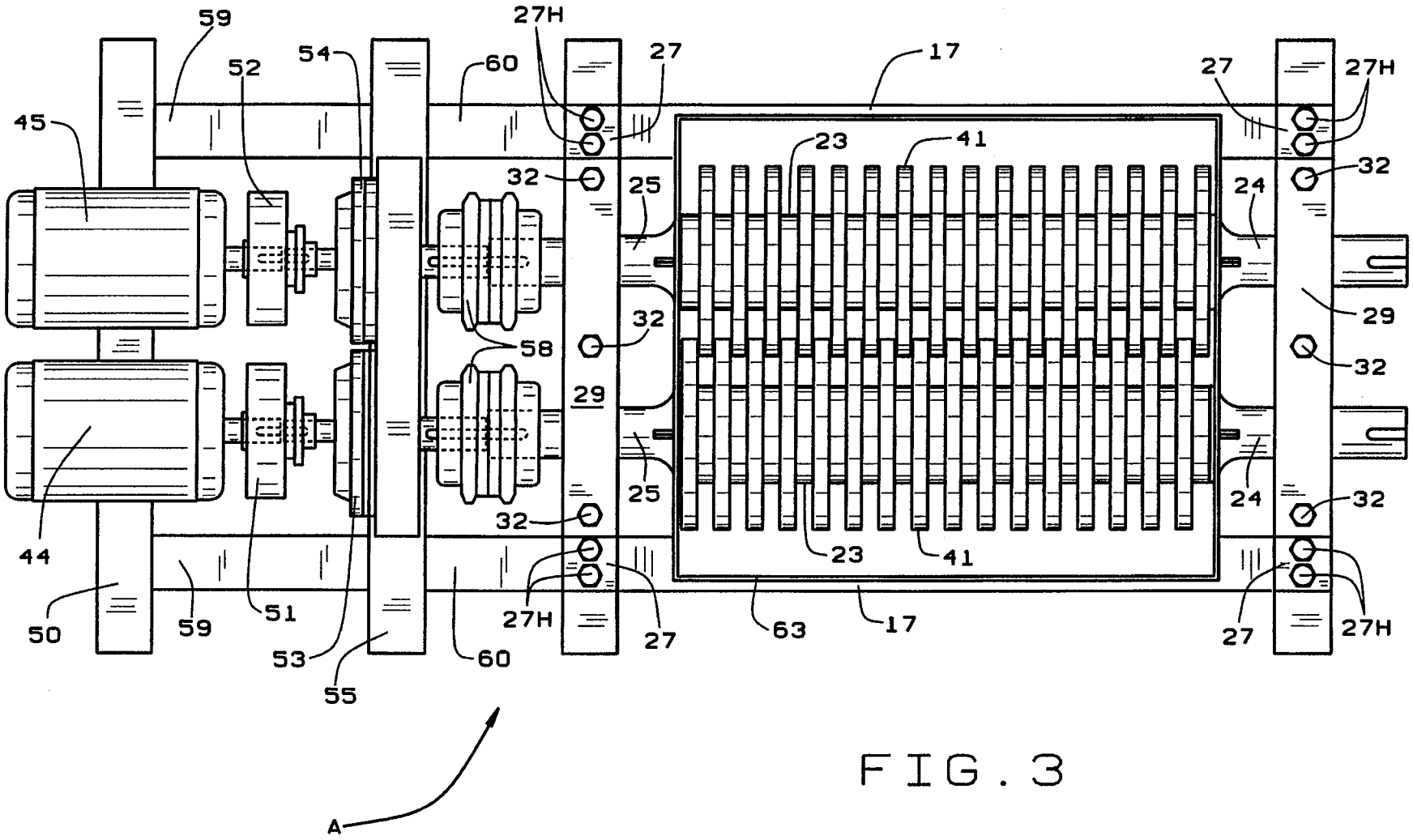
FIG. 3 is a longitudinal top view along line 3—3 in FIG. 1 of the apparatus showing the material reducing side-by-side rotors positioned in the hopper.
Figure 4:
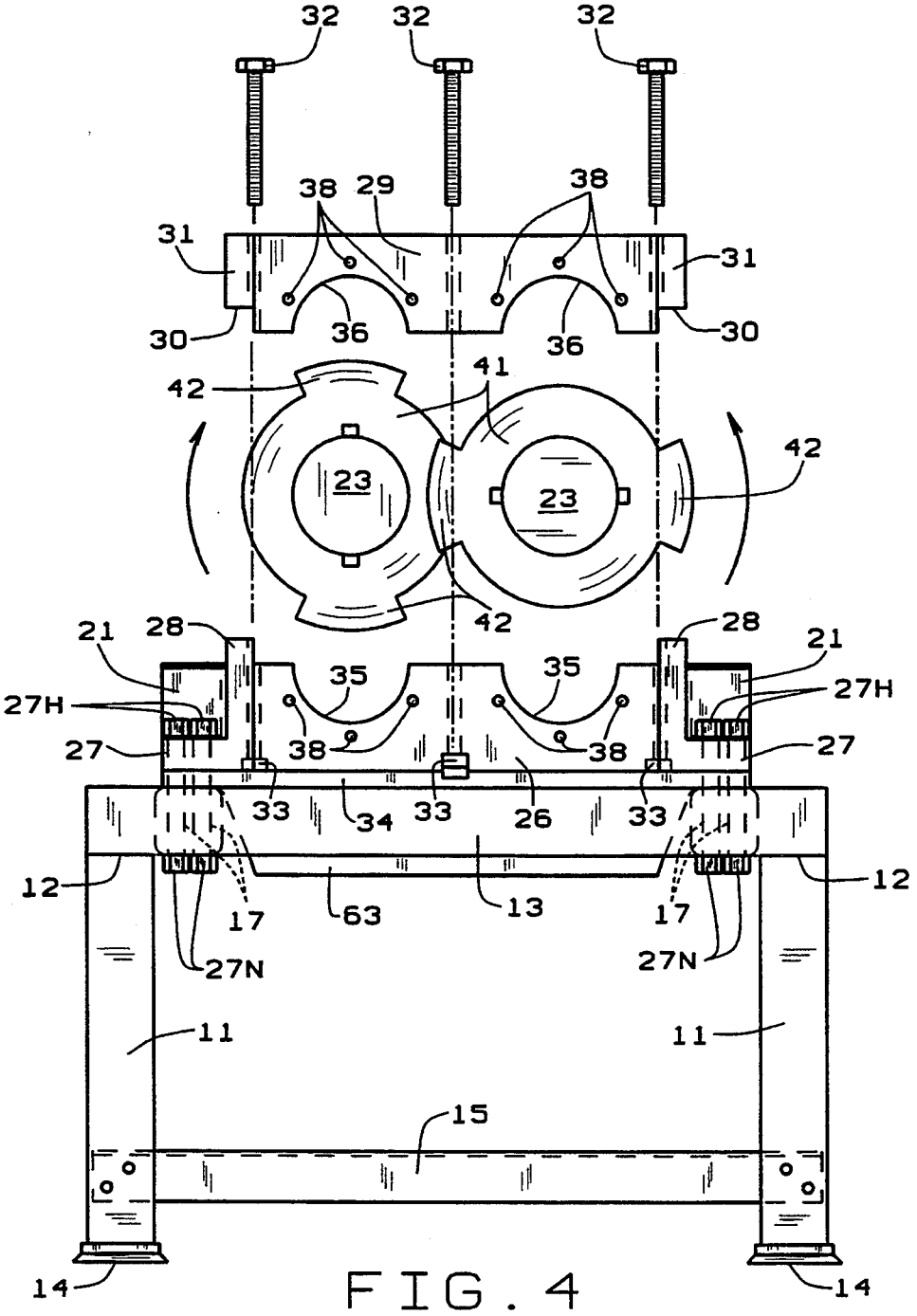
FIG. 4 is an exploded end view of the apparatus showing the nature of the split bearing to allow for removal of one or more of the shafts.
Figure 6:
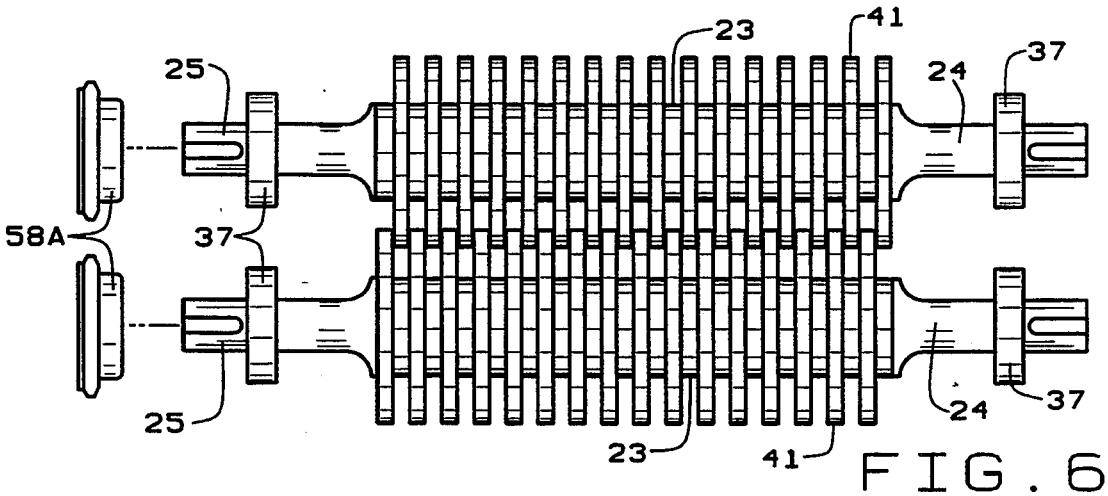
FIG. 6 is a longitudinal view with the shafts removed from the frame of the apparatus.
Figure 7:
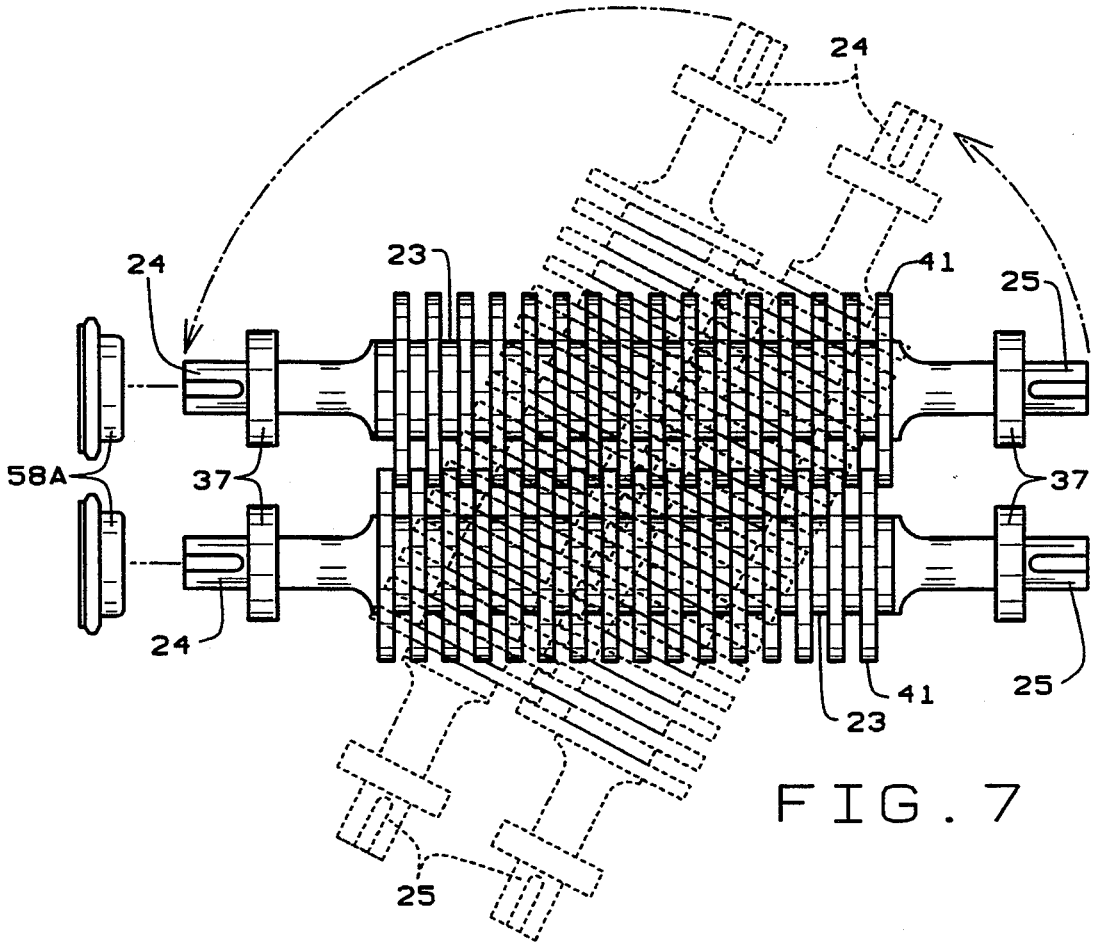
FIG. 7 is a schematic view to illustrate the procedure for changing the end-for-end positions of the shafts while lifted out of the frame of the apparatus.

Looking more specifically at FIGS. 2, 3 and 4, there is shown a split pillow block assembly composed of a bottom portion 26 positioned on top of the transverse beam 13. The portion 26 has opposite flanges 27 bolted to the beam 13 by a pair of through bolts with heads 27H on top of the flanges and threaded nuts 27N under the beam 13. The portion 26 has guide projections 28 for the purpose of aligning the top portion 29 of the split pillow block by having the projections mesh in the notches 30 in the end flanges 31 which abut the guides 28 when the two parts of the split pillow block are brought together, as shown in FIG. 2, and secured by elongated bolts 32 threaded into fixed nuts 33 on a mounting plate 34. Each pillow block portion is provided with semicircular cutouts 35 (in the bottom) and 36 (in the upper) for receiving shaft bearings 37. See FIGS. 6 and 7. Furthermore, the pillow blocks 26 and 29 are provided with holes 38 to receive attachment bolts for covers (not: shown).

Figure 5:
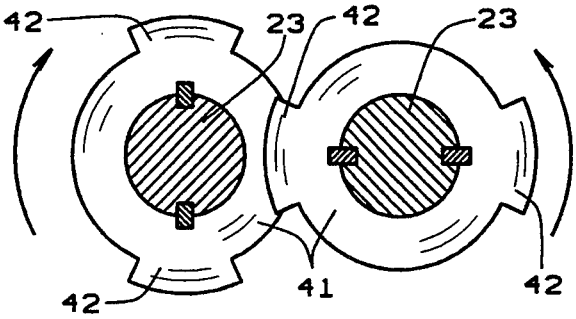
FIG. 5 is a shaft section view with the material cutters keyed thereto.

Shown in FIGS. 4 and 5 are the shafts 23 which carry the material cutter discs 41. Each cutter disc 41 is formed with a pair of double edge teeth 42 so that longer time in service is obtainable before a shaft 23 needs to be removed to replace the cutter discs 41. In order to obtain longer periods of use of cutters 41, either one or both of the shafts 23 seen in FIG. 6 can be bodily removed from the apparatus and swung around as in FIG. 7 to exchange either one of the shafts 23 end-for-end so the second unused cutter edges of teeth 42 will be presented for use.

A further feature of the apparatus resides in the shaft drive assembly which is best seen in FIGS. 1 and 3. As shown, there are a pair of electric motors 44 and 45 supported on a common stand 46 having vertical legs 47 with bottom footings 48 held in spaced relation by a flanged beam 49 extending between the pair of legs 47 (only one being shown but the stand 46 looks like the stand 10 in FIG. 2). The legs 46 carry a platform 50 on which both motors 44 and 45 are mounted. Motor 44 is a 200 HP model running at 1200 RPM and connected to a well known Falk controlled torque clutch 51, while motor 45 is a 200 HP model running at 1800 RPM and connected to a well known Falk controlled torque clutch 52 with speed switch, by Electro-Sensors, Inc. Speed Division, Model M100 or equivalent, responsive to the slippage in the shaft 23 to detect a jam condition. The Falk clutches 51 and 52 are shown in phantom so the motor drive shafts can be seen to be in alignment with the drive input shafts of cooperating R. R. Power transmission units 53 and 54 for the respective motors 44 and 45. While Reggiona Reduttori Power Transmission devices have been selected, it is of course possible to employ equivalent devices. The transmission units 53 and 54 are mounted on a platform 55 having vertical legs 56 interconnected by a beam 57, thereby forming a stand similar to the frame 10 shown in FIG. 2. The legs 56 have footings 56A. The output shafts of the transmission units 53 and 54 are in alignment with shafts 25 of the cutter shafts 23 as seen in FIG. 3. The aligned shafts are connected by suitable couplings 58 seen in FIGS. 1 and 3, while the detachable portions of the couplings are seen at 58A in FIGS. 6 and 7. The motor frame 46 and the transmission frame 55 are united by horizontal members 59, and the transmission frame 55 is united by a horizontal member 60 connected to the frame 10.

The material to be processed in the apparatus is received in a hopper frame 62 and after being ground by the cutter discs 41 is discharged through an outlet frame 63. That discharge material is intended to be deposited on a belt conveyor (not shown) carried on the cross beams 15 between legs 11.

Figure 8:
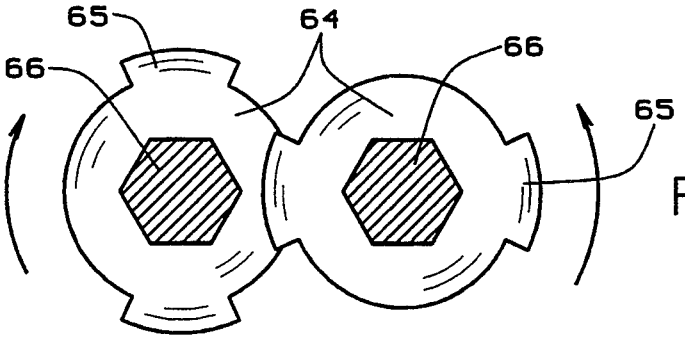
FIG. 8 is a modified form of hexagonal shafts and cutter discs which need no keyways to simplify assembly.

The rotatable shafts 23 carrying the cutter discs 41 are normally formed so that suitable keys are needed to obtain suitable driving connections. An alternate drive for cutter discs 64 having the double edge cutter 65 is seen in FIG. 8 where shafts 66 which substitute for shafts 23 are hexagonal in form and the cutter discs are broached to have a similar hexagonal aperture. Thus, the discs 64 and shafts 66 are matched to obtain the driving connection without keys and keyways.

Figure 9:
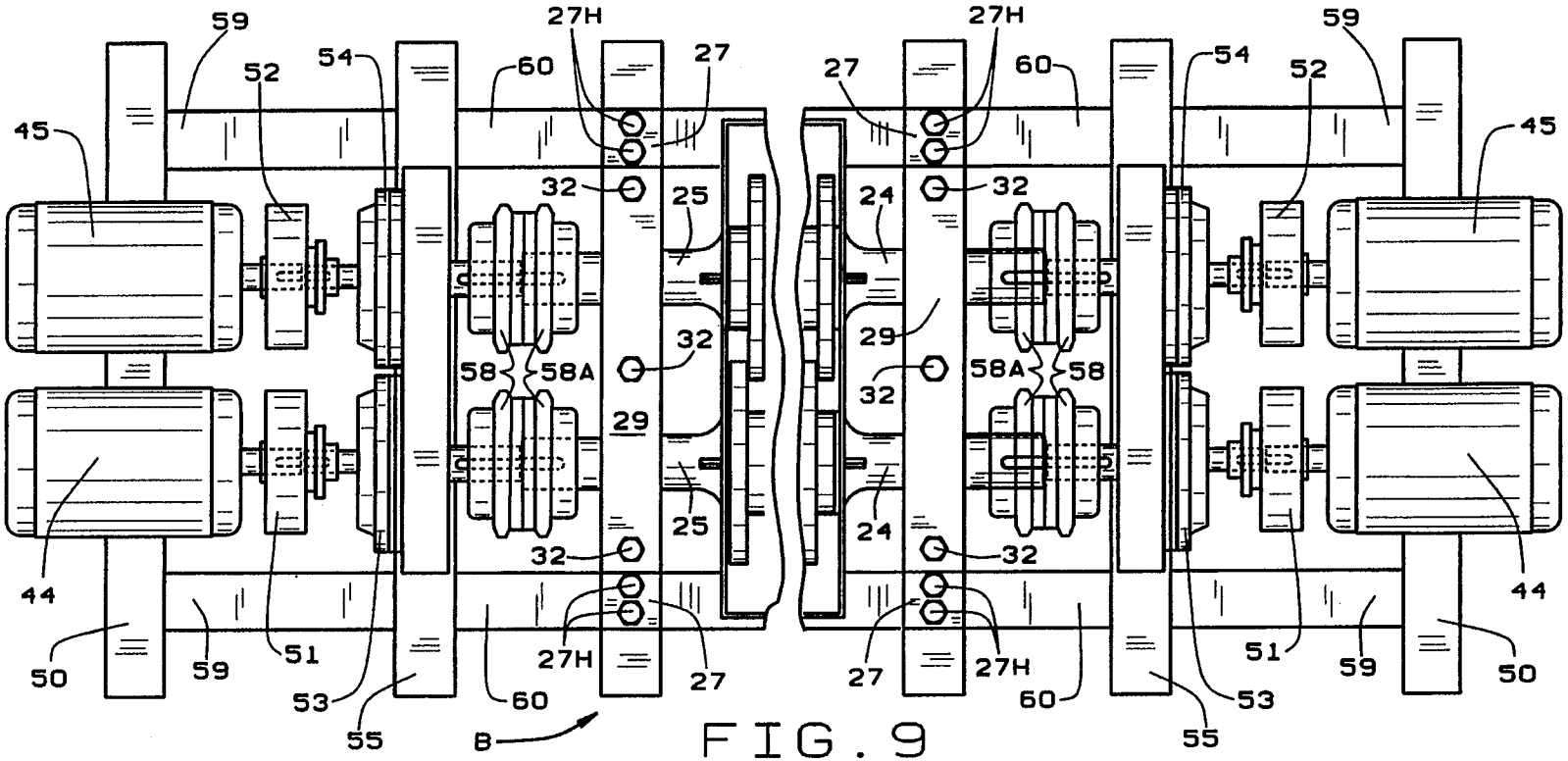
FIG. 9 is a longitudinal top view of a further embodiment of apparatus having the side-by-side rotors driven by dual motors with appropriate controls for forward and reversal operation.
Figure 10:
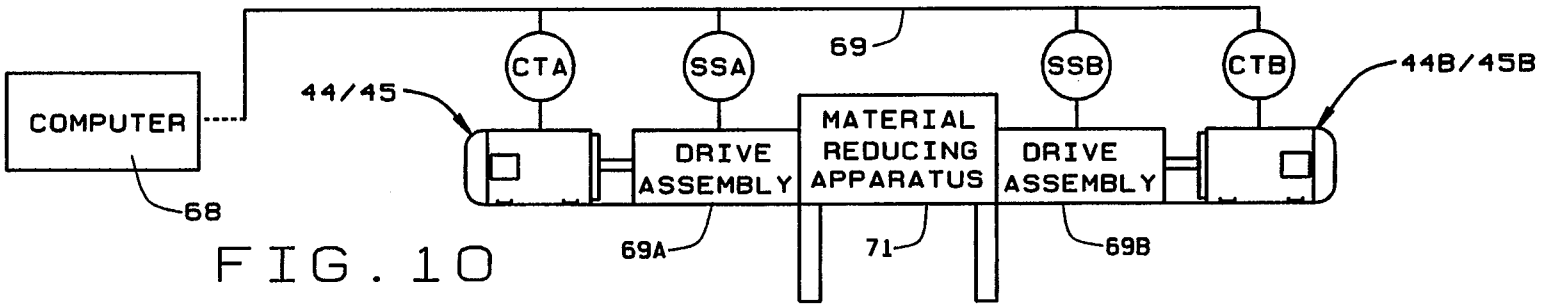
FIG. 10 is a schematic diagram of a suitable computer control system for motor operation.

Turning to FIGS. 9 and 10, there is shown schematically a control system suitable for either embodiment A or combined embodiments A and B. That system includes a computer device 68 connected by lead 69 to current transformers CTAin each of the pair of motors 44/45 and 44B/45B. That lead 69 is also connected to each of the drive assemblies 69A and 69B. While the foregoing disclosure has referred to Falk controlled torque clutches 51 and 52, and transmission units 53 and 54, it is understood that these components constitute a drive assembly so as to simplify the discussion of the control system.

It is understood that in normal operation using only the motors 44 and 45 in the embodiment A, the current to those motors stays in its normal value. When the material to be reduced contains sufficient tough or hard to reduce components, the motor torque increases to handle the increased load so long as the Falk clutches do not slip and send out a signal representing a change in the speed of the shafts 23. As an example, in the combined embodiments A and B of FIG. 9 let it be supposed that auto tires from passenger cars are progressively diminished and more truck tires are fed into the hopper 62. The shaft cutters 41 now encounter hard to reduce truck tires, and the Falk clutches can slip so the cutter shafts tend to or actually stall out. When this condition is reached the computer 70 in the control system of FIG. 10 responds through its drive assembly 69A to cut in the drive assembly 69B which adds the horsepower of the motors 44B/45B through the current transformer CTB. The computer is constructed to monitor the drive assemblies in relation to the load on the drive assemblies, and allow the material reduction unit 71 to function properly to add the horsepower from motors 44B/45B to the shafts 23 to carry the material reduction unit 71 through a load increase on the motors 44/45 by cutting in motors 44B/45B.

In the foregoing detailed description the apparatus is directed to material reducing rotary shafts with material cutters thereon which are double edged and set in releasable bearings so that the shafts, or either one, may be removed quite easily without disassembling a substantial part of the apparatus assembly. Each shafts is operatively connected to an electrical motor which operates through a Falk friction clutch and a speed reducing transmission means, with those drive components connected to the respective shafts through a coupling that permits de-coupling a shaft from its electric motor drive for removal from the apparatus. In the embodiment A of FIGS. 1 and 3 it is observed that on uncoupling either or both of the shafts carrying the material shredding disks, the arrangement is unique in that if either shaft and its cutters exhibits exceptional wear along its length the removal of that shaft can be effected through the coupling means and then can be turned end for end so as to even out the wear along the length of the shaft. In the embodiment A it is considered to be novel and unique in being able to uncouple and remove either rotary shaft and replace it with either a new shaft with cutters or a refurbished shaft and cutters.

In connection with the disclosure exhibited in FIG. 9 which is embodiment B there is the unique arrangement in a material reducing apparatus having dual electric motors at each end of the rotary shafts so that under normal material reducing operation only one pair of motors may be required and the other pair of motors merely free wheel and do not augment the drive on the shafts. However, in the event that the material fed into the apparatus includes difficult material to shred or cut which would normally cause the rotary shafts to slow down or actually stall out, a control system is associated with the apparatus so as to automatically sense shaft slow down or stall and energize the second pair of motors so that each shaft will be under the drive of a motor at each end of a shaft, and this arrangement can double the horsepower for each shaft so as to allow the apparatus to cut through difficult material without any serious stall or rotary slow down. It is unique in the operation of the last described apparatus to be able to uncouple either or both of the rotary shafts and to turn them end for end so that double edged cutting blades can be used to advantage without requiring the usual disassembly of apparatus which is expensive and time consuming.

The foregoing detailed description is directed to the best mode of material reduction apparatus in which a pair of cutter shafts with opposite projecting end portions all arranged in substantial parallelism are mounted in housing means which enclose the cutter supporting shafts by having the housing divided into a bottom portion and an upper portion which is removable along a parting line parallel to the cutting shaft axis. In that arrangement bearing means for the shaft end projections are mounted thereon to support the shafts in pillow blocks which in turn are split between bottom portions and removable top portions normally ,cooperating to embrace the shaft bearing means so that removable retainer means normally holding the pillow blocks embracing the bearing means can be removed to permit one or both of the cutter supporting shafts to be removed from the bottom portion of the pillow blocks.

That unique combination is rendered operative by having first motor drive assembly means operably connected to a first one of the pair of cutter shafts, and a second motor drive assembly means operably connected to a second one of the pair of cutter shafts, whereby the cutter shafts are independently driven by the respective transmission means thereby making it possible to interchange the shafts between transmission means, expecially when the transmission means have different rotatable speeds. It is pointed out that the motor means 44/45 are different in respect that one has 1800 RPM speed and the other has 1200 RPM speed, while the associated drive assembly reduces those speeds respectively to 18 and 12 RPM.

The best mode disclosure is further distinguished from the prior art by having a drive arrangement for material reducing apparatus in which first and second cutter shafts have oppositely axially projecting first and second ends mounted respectively in bearing means that are supported in split pillow blocks so as to rotatively support the cutter carrying shafts in parallel interchanged positions. That drive arrangement includes first and second motor means for the respective first and second cutter carrying shafts, and drive assemblies operatively connected between the motor means and the cutter carrier shaft for driving those shafts in counter rotating directions at different relative speeds. Furthermore, it is unique to be able to release the split pillow blocks from supporting the shaft bearings, thereby bodily repositioning the first and second cutter carrying shafts for utilizing the second cutter edges which are available in the tooth arrangement of the cutter disks.

While specific details of apparatus have been set forth it is of course understood that the scope of the invention is intended to embody equivalent apparatus to carry out the general purpose herein before expressed.

What is claimed is:

1. In material reducing apparatus, the combination including:

a) a pair of cutter supporting shafts having opposite projecting ends, and said shafts assume positions in substantial parallelism;

b) housing means enclosing said cutter supporting shafts and being divided along a parting line into bottom portions and upper portions with said upper portions removable along said parting line parallel to said cutter supporting shafts, and said opposite projecting ends of said shafts extending outside of said housing;

c) bearing means supporting said projecting ends of said cutter supporting shafts;

d) pillow blocks supporting said bearing means on said opposite ends of said cutter supporting shafts, said pillow blocks having normally fixed bottom portions and cooperating removable top portions normally positioned to embrace said bearing means; and e) removable retainer means normally holding said pillow blocks embracing said bearing means, said top portions of said pillow blocks being removable to permit said bearing means and cutter shafts supported thereby to be selectively interchanged end for end in said pillow blocks.

2. The combination set forth in claim 1 wherein said pair of cutter supporting shafts have double edge cutting teeth.

3. The combination set forth in claim 1 wherein first motor driven transmission means is operably connectable to a first one of said pair of cutter supporting shaft projecting ends, and a second motor driven transmission means is operably connectable to a second one of said pair of cutter supporting shaft projecting ends.

4. The combination set forth in claim 3 wherein said first and second motor driven transmission means have different rotational speeds.

5. A drive arrangement for material reducing apparatus comprising:

a) first and second cutter carrying shafts arranged in parallel positions with double edge cutters in operative material reducing cooperation presenting first edges of the double edge cutters to the material and having oppositely axially projecting first and second end portions;

b) bearing means mounted on said projecting shaft end portions;

c) split pillow blocks supporting said bearing means on said projecting shaft end portions to rotatively support said cutter carrying shafts in said parallel positions;

d) first and second motor means for said respective first and second cutter carrying shafts;

e) transmission means operatively connected between said first and second motor means and said first and second shafts for driving said cutter carrying shafts in counter rotating directions at different rotative speeds; and f) means to release said split pillow blocks from supporting said bearings for permitting repositioning said first and second cutter carrying shafts for operative connection with said first and second motor means such that said shafts present second edges of the double edge cutters for material reducing cooperation.

6. A driving arrangement for material reducing apparatus comprising:

a) first and second shafts in side by side parallel positions, said shafts having projecting opposite end portions;

b) bearing means engaged on said opposite end portions of said first and second shafts;

c) pillow blocks releasably supporting each of said bearing means;

d) first motor driven transmission means for connection to the first one of said parallel shaft's end portions;

e) second motor driven transmission means for connection to the second one of said parallel shaft's end portions; and f) means to permit release of said pillow blocks from said bearing means for selective reconnection of said first one of said shafts with said second motor driven transmission means and reconnection of said second one of said shafts with said first motor driven transmission.

7. The apparatus set forth in claim 6 wherein said first and second motor driven transmission means operate said first and second shafts at different speeds.

8. In material reducing apparatus of the character described, the combination comprising:

a) a cooperating pair of material reducing shafts having first and second oppositely extending end portions;

b) bearing means supporting said first and second oppositely extending end portions of each of said pair of shafts;

c) first motor means operatively connected to each of the first extending end portions of said pair of shafts;

d) second motor means operatively connected to each of the second oppositely extending end portions of said pair of shafts; and e) a control system operatively connected to said first and second motor means for selectively energizing said first motor means independently of said second motor means, and for cojointly energizing both said first and second motor means in response to said first and second shaft slow down.

9. The apparatus set forth in claim 8 wherein said bearing means is operative to release said first and second oppositely extending end portions of said pair of shafts to permit the selective exchanging of said pair of shafts with respect to said first and second motor means.

10. The apparatus set forth in claim 8 wherein said first motor means operates said pair of shafts at different rotational speeds, and said control means de-energizes said second motor means.

11. The apparatus set forth in claim 8 wherein said bearing means is operative to release said first and second end portions of said pair of shafts independently of said first and second motor means for permitting either of said shafts to be removed for exchange with a different shaft.

12. In material cutting apparatus comprising:

a) a frame;

b) bearing support means carried by said frame;

c) a first shaft having first and second end portions carried in said bearing support means;

d) a second shaft having first and second end portions carried in said bearing support means;

e) material cutter disc means carried on said first and second shafts between said respective opposite ends, said cutter disc means having double edged teeth initially mounted on said shafts in position to present a first one of said double edges in operative position for cutting material;

f) drive motor means disconnectable operably for driving each of said first and second shafts; and g) means on said bearing support means and in said disconnectable motor drive means to disconnect said operable drive to said first and second shafts for enabling end for end switching said first and second end portion of said shafts relative to said drive motor means, whereby to present a second one of said disc double edges in position to cut material.

13. The material cutting apparatus set forth in claim 12 wherein said drive motor means for each of said first and second shafts includes a friction clutch to permit shaft stall out in response to encountering hard to cut material.

14. The material cutting apparatus set forth in claim 12 wherein a control system is operably connected to said drive motor means for automatically sensing shaft rotation drive slow down.

15. In material cutting apparatus, the improvement which comprises:

a) a first pair of shafts each supporting material cutting disc;

b) a replacement pair of shafts provided with material cutting discs;

c) first shaft driving motor means having a power delivery clutch means responsive to shaft slow down;

d) means for connecting said first pair of shafts to said power delivery clutch means;

e) second shaft driving motor means having other clutch means operable in normally non-driving connection with said first pair of shafts; and f) control means in said apparatus having a connection with both said first shaft driving motor means and said other clutch means operable to energize said normally non-driving connection with said second shaft driving motor means; said control means being operative for sensing first pair of shafts slow down and energizing said second shaft driving motor means through said other clutch means to deliver driving operation of said first pair of shafts to overcome shaft slow down.

* * * * *